US009477166B2

(12) United States Patent
Iwazaki et al.

(10) Patent No.: US 9,477,166 B2
(45) Date of Patent: Oct. 25, 2016

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Eisuke Iwazaki, Kanagawa (JP); Asafumi Fujita, Kanagawa (JP); Tomoaki Tanaka, Kanagawa (JP); Narumasa Sato, Kanagawa (JP); Kotaro Yoshihara, Kanagawa (JP); Noriyuki Mizutani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/613,785

(22) Filed: Feb. 4, 2015

(65) Prior Publication Data

US 2016/0085168 A1 Mar. 24, 2016

(30) Foreign Application Priority Data

Sep. 19, 2014 (JP) ..... 2014-191947

(51) Int. Cl.

| | |
|---|---|
| ***G03G 9/093*** | (2006.01) |
| ***G03G 9/087*** | (2006.01) |
| ***G03G 9/08*** | (2006.01) |
| ***G03G 9/107*** | (2006.01) |

(52) U.S. Cl.

CPC ..... *G03G 9/08755* (2013.01); *G03G 9/0823* (2013.01); *G03G 9/0827* (2013.01); *G03G 9/107* (2013.01)

(58) Field of Classification Search

CPC ..... G03G 9/08711; G03G 9/08755; G03G 9/093; G03G 9/0935; G03G 9/113; G03G 9/09335

See application file for complete search history.

(56) References Cited

U.S. PATENT DOCUMENTS

| | | | | |
|---|---|---|---|---|
| 5,733,692 | A | 3/1998 | Nagase et al. | |
| 2005/0058927 | A1* | 3/2005 | Mikuriya | G03G 9/0825 430/110.2 |
| 2008/0096119 | A1* | 4/2008 | Yamamoto | G03G 9/0804 430/109.4 |
| 2008/0124635 | A1* | 5/2008 | Nakamura | G03G 9/0819 430/48 |
| 2012/0040285 | A1* | 2/2012 | Shibata | G03G 9/09328 430/110.2 |
| 2014/0127620 | A1* | 5/2014 | Bayley | G03G 9/09321 430/108.2 |
| 2014/0134532 | A1* | 5/2014 | Sumioka | G03G 9/09371 430/109.4 |
| 2014/0134535 | A1* | 5/2014 | Baba | G03G 9/1133 430/111.35 |
| 2015/0118610 | A1* | 4/2015 | Nosella | G03G 9/09392 430/108.3 |
| 2015/0118613 | A1* | 4/2015 | Nosella | G03G 9/08711 430/109.3 |

FOREIGN PATENT DOCUMENTS

| | | | | |
|---|---|---|---|---|
| JP | 3521373 B2 | | 2/2004 | |
| JP | 2004-126006 A | | 4/2004 | |
| JP | 2007017962 | * | 1/2007 | G03G 9/08 |

* cited by examiner

*Primary Examiner* — Hoa V Le
(74) *Attorney, Agent, or Firm* — Oliff PLC

(57) ABSTRACT

An electrostatic charge image developing toner, includes toner particles containing a binder resin including a polyester resin, a release agent including a hydrocarbon wax, and a styrene (meth)acrylic resin, wherein 70% or more of the release agent is present within 800 nm from a surface of the toner particles, the styrene (meth)acrylic resin in the toner particles forms a domain having an average diameter from 0.3 μm to 0.8 μm, and a number ratio of the domain being in a range of ±0.1 μm of the average diameter is 65% or more.

19 Claims, 2 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2014-191947 filed Sep. 19, 2014.

BACKGROUND

1. Technical Field

The present invention relates to an electrostatic charge image developing toner, an electrostatic charge image developer, and a toner cartridge.

2. Related Art

A method for visualizing image information through an electrostatic charge image according to an electrophotographic method and the like is used in various fields nowadays. In the electrophotographic method, the image information is formed as the electrostatic charge image on a surface of an image holding member (photoreceptor) by a charging and exposing process, the electrostatic charge image is developed on a surface of the photoreceptor by using a developer which includes a toner, and is visualized as an image through a transfer process of transferring the toner image onto a recording medium, such as a paper sheet, and further, through a fixing process of fixing the toner image on the surface of the recording medium.

SUMMARY

According to an aspect of the invention, there is provided an electrostatic charge image developing toner, including:

toner particles containing:

a binder resin including a polyester resin;

a release agent including a hydrocarbon wax; and a styrene (meth)acrylic resin, wherein 70% or more of the release agent is present within 800 nm from a surface of the toner particles, the styrene (meth)acrylic resin in the toner particles forms a domain having an average diameter from 0.3 μm to 0.8 μm, and a number ratio of the domain being in a range of ±0.1 μm of the average diameter is 65% or more.

BRIEF DESCRIPTION OF THE DRAWINGS

Exemplary embodiments of the present invention will be described in detail based on the following figures, wherein.

DETAILED DESCRIPTION

Figure 1:
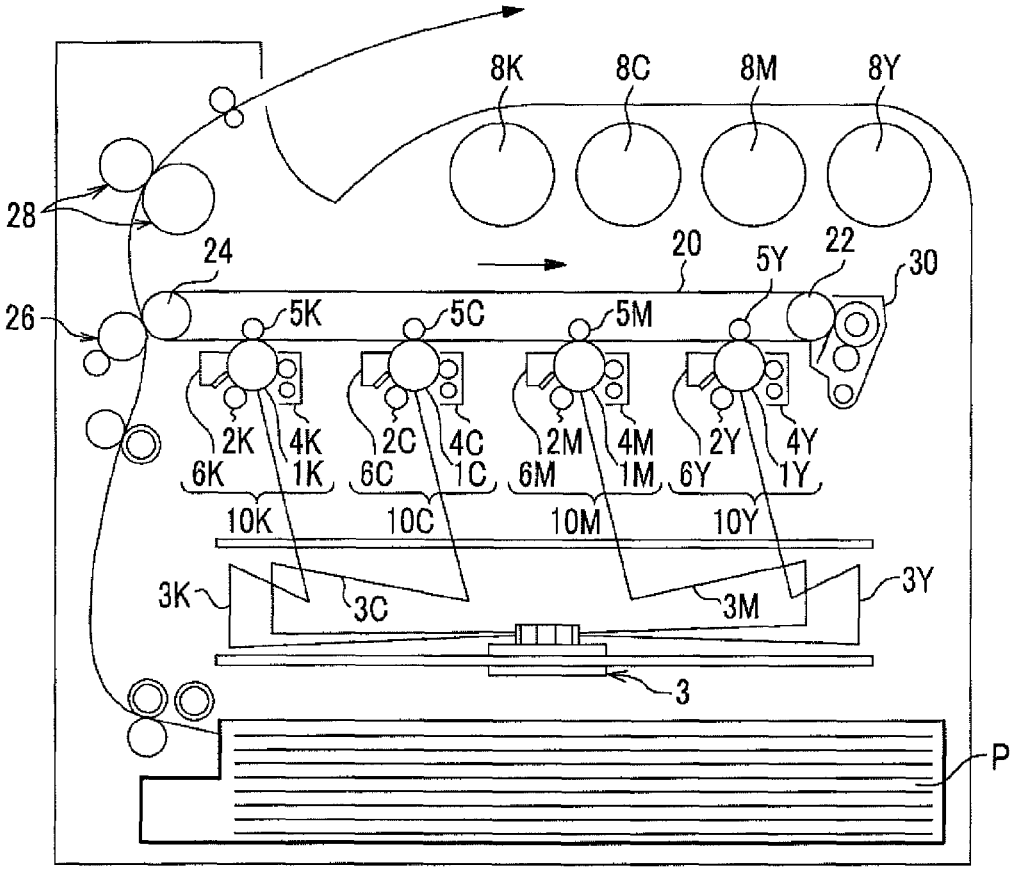
FIG. 1 is a schematic configuration view illustrating an example of an image forming apparatus according to an exemplary embodiment.

Hereinafter, an exemplary embodiment will be described in detail as an example of the invention.

Electrostatic Charge Image Developing Toner

An electrostatic charge image developing toner (hereinafter, referred to as a "toner") according to the exemplary embodiment includes a toner particle containing a binder resin which has a polyester resin, a release agent which has a hydrocarbon wax, and a styrene (meth)acrylic resin.

In the toner particle, 70% or more of the total release agent is present within 800 nm from a surface of the toner particle. The styrene (meth)acrylic resin forms a domain having an average diameter from 0.3 μm to 0.8 μm in the toner particle, and a number ratio of the domain being in a range of ±0.1 μm of the average diameter is 65% or more.

A state where the styrene (meth)acrylic resin forms the domain in the toner particle means a state where a sea-island structure in which the binder resin forms a sea portion and the styrene (meth)acrylic resin forms an island portion is formed. The domain of the styrene (meth)acrylic resin is, in other words, the island portion of the sea-island structure.

After a low density image (for example, an image having an image density of 5% or less) at a high temperature and high humidity (for example, when the temperature is 30° C. and the humidity is 90 RH %) is formed, even when a high density image (for example, an image having an image density of 90% or more) is formed, the toner according to the exemplary embodiment prevents generation of an aurora phenomenon (a phenomenon in which a wave-shaped band image is formed). The reason therefor is not clear, but the reasons described below are assumed as the reason thereof.

In the toner particle which includes the polyester resin, the styrene (meth)acrylic resin, and the hydrocarbon wax, the polyester resin forms a matrix (sea portion), while the styrene (meth)acrylic resin and the hydrocarbon wax form the domain (island portion) together. This is because the compatibility of the polyester resin with the styrene (meth) acrylic resin and the hydrocarbon wax is low.

However, with respect to an electrostatic charge image developer (hereinafter, also referred to as a "developer") which has a toner and a carrier, when the low density image is repeatedly formed at a high temperature and high humidity, since an amount of the toner developed is small, in a developing unit, the same developer continues being stirred, and a phenomenon in which the toner particle is excessively charged is caused. When a toner particle which includes a polyester resin, a styrene (meth)acrylic resin, and a hydrocarbon wax is excessively charged, a charging distribution tends to widen. It is considered that this is because a domain diameter of the styrene (meth)acrylic resin is large, and the domain diameter has variation (dispersion) of diameter, and according to this, a local polarization is generated. In addition, this is because, since the styrene (meth)acrylic resin and the hydrocarbon wax have a high compatibility, in the toner particle, the domains are likely to approach each other, the visible domain diameter of the styrene (meth) acrylic resin becomes large and dispersion of the visible domain diameter also becomes large, and the above-described local polarization further increases.

Meanwhile, in the developing unit, when the same developer continues being stirred, since the carrier is also excessively charged, a distance between the carriers widens and a visible volume of the developer increases. When the visible volume of the developer is increased, a toner concentration of the visible developer is also lowered. In this case, in the developing unit, a replenish toner is supplied, and the toner concentration of the developer excessively increases.

As a result, the charging distribution of the toner particle widens, and the toner particles are likely to be aggregated with each other. In addition, if the toner concentration of the developer excessively increases, in the developing unit, a phenomenon in which the aggregated toner (toner particle) remains on a near side (on an upstream side of a rotating direction of a developing roll of a layer regulating member)

of the layer regulating member which regulates a thickness of a layer of the developer (toner) that is held by the developing roll, which transports the toner particle to a developing region with the image holding member.

After this, when forming the high density image, a consumption amount of the toner increases, and in the developing unit, the toner concentration of the developer keeps lowering. When the toner concentration lowers, at the near side of the layer regulating member, the remaining aggregated toner (toner particle) is released. In this case, a phenomenon, in which the aggregated toner (toner particle) is used for development to thereby form a wave-shaped band image, is formed. The wave-shaped band image is an image which is formed along an axial direction of the image holding member, and is an image having a gradually lowering concentration toward the other end portion from one end of the circumferential direction of the image holding member (width direction of the band image) which looks similar to an aurora. For this reason, a phenomenon in which this band image is formed is referred to as an aurora phenomenon.

In contrast, in the case where the diameter of the domain of the styrene (meth)acrylic resin is reduced as long as the average diameter of domain thereof falls within the range from 0.3 μm to 0.8 μm and the number ratio of the domain being in the range of ±0.1 μm of the average diameter is 65% or more to thereby narrow a distribution of the domain diameter, generation of the local polarization caused by the domain diameter of the styrene (meth)acrylic resin and dispersion of the domain diameter is prevented.

Meanwhile, if the release agent is controlled so that 70% or more of the release agent among the total release agent which includes the hydrocarbon wax is present in a surface layer portion which is within 800 nm from the surface of the toner particle, in the toner particle, the domains of the styrene (meth)acrylic resin and the release agent are unlikely to approach each other, and an increase in the visible domain and dispersion of the domain diameter of the styrene (meth) acrylic resin are prevented. For this reason, generation of the local polarization caused by the domain diameter and dispersion of the domain diameter of the styrene (meth)acrylic resin are prevented.

Accordingly, even when the toner particle which includes the styrene (meth)acrylic resin and the hydrocarbon wax is excessively charged, widening of the charging distribution of the toner particle is prevented, and the aggregation of the toner (toner particle) is unlikely to be generated. As a result, in the case where the low density image is repeatedly formed to cause not only the toner particle to be excessively charged, but also the toner concentration of the developer to be excessively increased, on the near side (on the upstream side of the rotating direction of the developing roll of the layer regulating member) of the layer regulating member, the aggregated toner (toner particle) is prevented from remaining.

As described above, even when the high density image is formed, after the low density image is formed at a high temperature and high humidity, it is assumed that the toner according to the exemplary embodiment prevents generation of an aurora phenomenon (a phenomenon in which the wave-shaped band image is formed).

Here, in the toner according to the exemplary embodiment, 70% or more of the total release agent is present within 800 nm from the surface of the toner particle. Hereinafter, a abundance ratio of the release agent which is present within 800 nm from the surface of the toner particle is referred to as an "abundance of the release agent".

The abundance of the release agent is 70% or more, preferably 80% or more, in the viewpoint of preventing generation of an aurora phenomenon. An upper limit value of the abundance of the release agent is preferably 100%.

Meanwhile, the average diameter of the domains of the styrene (meth)acrylic resin is from 0.3 μm to 0.8 μm. The average diameter is preferably from 0.35 μm to 0.7 μm in the viewpoint of preventing generation of an aurora phenomenon, and more preferably from 0.4 μm to 0.6 μm.

In the domain of the styrene (meth)acrylic resin, the number ratio of the domain being in the range of ±0.1 μm of the average diameter is 65% or more. The number ratio is preferably 70% or more in the viewpoint of preventing generation of an aurora phenomenon, and more preferably 75% or more. However, from the viewpoint that the charging distribution is too narrow, and fog is likely to be generated, the ratio may be 99.5% or less.

Hereinafter, a measuring method of the abundance of the release agent and the average diameter of the domains of the styrene (meth)acrylic resin will be described.

A sample and an image for measurement are prepared by the following method.

The toner is mixed into an epoxy resin and embedded, and the epoxy resin is solidified. The obtained solidified product is cut by an ultramicrotome apparatus (Ultracut UCT manufactured by Leica), and a thin sample having a thickness from 80 nm to 130 nm is prepared. Next, the obtained thin sample is dyed for three hours by ruthenium tetroxide in a desiccator at 30° C. Then, by an ultra-high resolution field emission scanning electron microscope (FE-SEM, S-4800 manufactured by Hitachi High-Technologies), a SEM image of a dyed thin sample is obtained. Since it is easy to perform dyeing by ruthenium tetroxide in an order of the release agent, the styrene (meth)acrylic resin, and the polyester resin, each component is identified by light and shade caused by a dyed extent. When it is difficult to determine the light and shade because of a state or the like of the sample, the dyeing time is adjusted.

In addition, on a cross section of the toner particle, since the domain of a colorant is smaller than the domain of the release agent and the domain of the styrene (meth)acrylic resin, it is possible to distinguish the domain by size.

The abundance of the release agent is a value which is measured by the following method.

In the SEM image, a cross section of the toner particle which has a maximum length that is 85% or more of the volume average diameter of the toner particle is selected, the domain of the dyed release agent is observed, and an area of the release agent of the entire toner particle and an area of the release agent which is present in a region within 800 nm from the surface of the toner particle are acquired, and a ratio of both areas (an area of the release agent which is present in the region within 800 nm from the surface of the toner particle/an area of the release agent of the entire toner particle) is calculated. Then, the calculation is performed with respect to 100 toner particles, and an average value thereof is set as the abundance of the release agent.

The reason why the cross section of the toner particle which has a maximum length that is 85% or more of the volume average diameter of the toner particle is selected, is that there is a possibility of cutting an end portion since the toner is three-dimensional since the SEM image is a cross section, and causing the cross section of the end portion not to reflect the domain of the release agent of the toner.

The average diameter of the domains of the styrene (meth)acrylic resin is a value which is measured by the following method.

In the SEM image, 30 cross sections of the toner particles which have the maximum length that is 85% or more of the volume average diameter of the toner particle are selected, and a total of 100 domains of the dyed styrene (meth)acrylic resin are observed. The maximum length of each domain is measured. The maximum length is set as the diameter of the domain, and an arithmetical average thereof is set as the average diameter.

In addition, based on each diameter of the measured total 100 domains, the number ratio of the domain being in the range of ±0.1 μm of the average diameter is determined.

The control method of setting the abundance of the release agent to be 70% or more is, for example, a method of allowing the toner particle to have a core-shell structure and using the release agent when forming a shell.

The average diameter of the domain of the styrene (meth) acrylic resin, and the distribution of the domain size, are controlled, for example, by preparing the toner particle by aggregation and coalescence, and adjusting the volume average particle diameter of a resin particle which is included in a styrene (meth)acrylic resin particle dispersion which is used when preparing the toner particle, and by preparing plural styrene (meth)acrylic resin particle dispersions which have different volume average particle diameters from each other and using the dispersion in combination therewith.

Hereinafter, the toner according to the exemplary embodiment will be described in detail.

The toner according to the exemplary embodiment has the toner particle. The toner may have an external additive which is externally added to the toner particle.

Toner Particle

The toner particle includes the binder resin, the release agent which includes the hydrocarbon wax, and the styrene (meth)acrylic resin. The toner particle may include other internal additives, such as a colorant.

The toner particle has, for example, the sea-island structure in which the release agent and the styrene (meth)acrylic resin are dispersed in the binder resin.

Binder Resin

As the binder resin, the polyester resin is employed in the viewpoint of fixability. The ratio of the polyester resin with respect to the entire binder resin may be, for example 85% by weight or more, preferably 95% by weight or more, and more preferably 100% by weight.

As the polyester resin, for example, a known polyester resin is employed.

As the polyester resin, for example, a polycondensate of a polyhydric carboxylic acid and a polyol, is employed. In addition, as the polyester resin, a commercial product may be used, or a synthesized resin may be used.

Examples of the polyhydric carboxylic acid include an aliphatic dicarboxylic acid (for example, an oxalic acid, a malonic acid, a maleic acid, a fumaric acid, a citraconic acid, an itaconic acid, a glutaconic acid, a succinic acid, an alkenylsuccinic acid, an adipic acid, or a sebacic acid), an alicyclic dicarboxylic acid (for example, a cyclohexanedicarboxylic acid), an aromatic dicarboxylic acid (for example, a terephthalic acid, an isophthalic acid, a phthalic acid, or a naphthalenedicarboxylic acid), an anhydride of these acids, or a lower (for example, 1 to 5 carbon atoms) alkyl ester of these acids. Among these, as the polyhydric carboxylic acid, for example, the aromatic dicarboxylic acid is preferable.

As the polyhydric carboxylic acid, both the dicarboxylic acid and the carboxylic acid which forms a crosslinking structure or a branch structure and has a valence of 3 or more may be used in combination. Examples of the carboxylic acid which has a valence of 3 or more include a trimellitic acid, a pyromellitic acid, an anhydride of these acids, or a lower (for example, 1 to 5 carbon atoms) alkyl ester of these acids.

One type of polyhydric carboxylic acid may be used singly, or two or more types of polyhydric carboxylic acid may be used together.

Examples of the polyol include aliphatic diol (for example, ethylene glycol, diethylene glycol, triethylene glycol, propylene glycol, butanediol, hexanediol, or neopentyl glycol), alicyclic diol (for example, cyclohexanediol, cyclohexanedimethanol, or hydrogenated bisphenol A), or aromatic diol (for example, ethylene oxide adduct of bisphenol A, or propylene oxide adduct of bisphenol A). Among these, as the polyol, for example, the aromatic diol and the alicyclic diol are preferable, and the aromatic diol is more preferable.

As the polyol, both a diol and an alcohol which obtains the crosslinking structure or the branch structure and has a valence of 3 or more may be used in combination. Examples of the alcohol having a valence of 3 or more include glycerin, trimethylol propane, or pentaerythritol.

One type of polyol may be used singly, or two or more types of polyol may be used together.

A glass transition temperature (Tg) of the polyester resin is preferably from 50° C. to 80° C., and more preferably from 50° C. to 65° C.

The glass transition temperature is determined by a DSC curve which is obtained by differential scanning calorimetry (DSC). More specifically, the glass transition temperature is determined by an "extrapolated starting temperature of glass transition" described in a determining method of the glass transition temperature of a JIS K7121-1987 "transition temperature measurement method of plastic".

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight of the resin are measured by a gel permeation chromatography (GPC). The measurement of the molecular weight by the GPC is performed by using an HLC-8120 manufactured by Tosoh Corporation as a measurement apparatus, a TSKgel SuperHM-M15 cm manufactured by Tosoh Corporation as a column, and tetrahydrofuran as a solvent. The weight average molecular weight and the number average molecular weight are calculated by using a molecular weight calibration curve which is drawn up by a monodispersed polystyrene reference sample from the measurement result.

The polyester resin may be obtained by a known measuring method. Specifically, for example, the polyester resin may be obtained by a reaction method of setting a polymerization temperature from 180° C. to 230° C., reducing pressure in a reaction system as necessary, and removing water or alcohol generated during condensation.

When a monomer of a raw material is not dissolved or is not compatible at a reaction temperature, a solvent having a high boiling point may be added as a solubilizing agent to thereby dissolve the monomer. In this case, the polycondensation reaction is performed while distilling the solubilizing agent. When a monomer having a low compatibility in a copolymerization reaction exists, after condensing the monomer having a low compatibility and an acid or alcohol which is planned to be polycondensed with the monomer in advance, a main component may be polycondensed together.

A content of the binder resin, for example, with respect to the entire toner particle, is preferably from 40% by weight to 95% by weight, more preferably from 50% by weight to 90% by weight, and still more preferably from 60% by weight to 85% by weight.

As the binder resin, both the polyester resin and other binder resins may be used in combination.

Examples of other binder resins include: a homopolymer of the monomer, such as a styrene type (for example, styrene, p-chloro styrene, or α-methylstyrene), a (meth) acrylate ester type (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexy methacrylate), an ethylenic unsaturated nitrile type (for example, acrylonitrile or methacrylonitrile), a vinyl ether type (for example, vinylmethylether or vinyl isobutyl ether), a vinyl ketone type (for example, vinyl methyl ketone, vinyl ethyl ketone, or vinyl isopropenyl keton), an olefin type (for example, ethylene, propylene, or butadiene); or a vinyl resin (however, except the styrene (meth)acrylic resin) which is configured of a copolymer which is combined by two or more types of these monomers.

Examples of other binder resins also include: a non-vinyl resin, such as an epoxy resin, a polyester resin, a polyurethane resin, a polyamide resin, a cellulosic resin, a polyether resin, or a modified rosin; a mixture of these resins and the above-described vinyl resins; or a graft polymer which is obtained by polymerizing vinyl monomers in the coexistence of these resins.

One type of these other binder resin may be used singly, or two or more types of other binder resins may be used together.

Styrene (Meth)Acrylic Resin

The styrene (meth)acrylic resin is a copolymer which is made by copolymerizing at least a monomer which has a styrene skeleton and a monomer which has a (meth)acrylate skeleton. The "(meth)acryl" is an expression which includes both an "acrylate" and a "methacrylate".

Examples of the monomers (hereinafter, referred to as a "styrene monomer") which has the styrene skeleton include styrene, alkyl-substituted styrene (for example, α-methyl styrene, 2-methyl styrene, 3-methyl styrene, 4-methyl styrene, 2-ethyl styrene, 3-ethyl styrene, or 4-ethyl styrene), halogen-substituted styrene (for example, 2-chlorostyrene, 3-chlorostyrene, or 4-chlorostyrene), or vinylnaphthalene. One type of styrene monomer may be used singly, or two or more types of styrene monomers may be used together.

Among these, as the styrene monomer, styrene is preferable from the viewpoint that styrene is likely to react, the reaction of styrene is likely to be controlled, and further, styrene is highly available.

Examples of the monomer (hereinafter, referred to as a "(meth)acrylic monomer") which has the (meth)acrylate skeleton include (meth)acrylic acid and a (meth)acrylate ester. Examples of the (meth)acrylate ester include (meth) acrylate alkyl ester (for example, n-methyl(meth)acrylate, n-ethyl(meth)acrylate, n-propyl(meth)acrylate, n-butyl (meth)acrylate, n-pentyl(meth)acrylate, n-hexyl acrylate, n-heptyl(meth)acrylate, n-octyl(meth)acrylate, n-decyl (meth)acrylate, n-dodecyl(meth)acrylate, n-lauryl(meth) acrylate, n-tetradecyl(meth)acrylate, n-hexadecyl(meth) acrylate, n-octadecyl(meth)acrylate, isopropyl(meth) acrylate, isobutyl(meth)acrylate, t-butyl(meth)acrylate, isopentyl(meth)acrylate, amyl(meth)acrylate, neopentyl (meth)acrylate, isohexyl(meth)acrylate, isoheptyl(meth) acrylate, isooctyl(meth)acrylate, 2-ethylhexy (meth)acrylate, cyclohexyl(meth)acrylate, or t-butylcyclohexyl(meth) acrylate), aryl ester (meth)acrylate (for example, phenyl (meth)acrylate, biphenyl(meth)acrylate, diphenylethyl (meth)acrylate, t-butylphenyl(meth)acrylate, or terphenyl (meth)acrylate), dimethylaminoethyl(meth)acrylate, diethylaminoethyl(meth)acrylate, methoxyethyl(meth)acrylate, 2-hydroxyethyl(meth)acrylate, β-carboxyethyl(meth) acrylate, or (meth)acrylamide. One type of the (meth)acrylic monomer may be used singly, or two or more types of the (meth)acrylic monomers may be used together.

A copolymerization ratio (on a weight basis, styrene type monomer/(meth)acrylic monomer) of the styrene type monomer and the (meth)acrylic monomer may be 85/15 or 70/30, for example.

In the viewpoint of preventing generation of an aurora phenomenon, the styrene (meth)acrylic resin may have the crosslinking structure. Examples of the styrene (meth) acrylic resin which has the crosslinking structure include a crosslinked product which is copolymerized by at least the monomer having the styrene skeleton, the monomer having the (meth)acrylate skeleton, and a crosslinkable monomer, and is crosslinked.

Examples of the crosslinkable monomer include a crosslinking agent which has two or more functional groups.

Examples of the crosslinking agent which has two or more functional groups include divinylbenzene, divinylnaphthalene, a di(meth)acrylate compound (for example, diethylene glycol di(meth)acrylate, methylenebis(meth) acrylamide, decanediol diacrylate, or glycidyl(meth)acrylate), polyester type di(meth)acrylate, or 2-([1'-methyl propylidene amino]carboxyamino)ethyl methacrylate.

Examples of the crosslinking agent which has multiple functional groups include tri(meth)acrylate compound (for example, pentaerythritol tri(meth)acrylate, trimethylolethane tri(meth)acrylate, or trimethylolpropane tri(meth) acrylate), tetra(meth)acrylate compound (for example, tetramethylolmethane tetra(meth)acrylate, or oligoester (meth)acrylate), 2,2-bis(4-methacryloxy, polyethoxyphenyl) propane, diallyl phthalate, triallyl cyanurate, triallyl isocyanurate, triallyl trimellitate, or diallyl chlorendate.

A copolymerization ratio (on a weight basis, crosslinkable monomer/entire monomer) of the crosslinkable monomer with respect to the entire monomer may be 2/1000 or 30/1000, for example.

In the viewpoint of preventing generation of an aurora phenomenon, a weight average molecular weight of the styrene (meth)acrylic resin may be from 30000 to 200000, preferably from 40000 to 100000, and more preferably, from 50000 to 80000, for example.

The weight average molecular weight of the styrene (meth)acrylic resin is a value which is measured by the same method as the weight average molecular weight of the polyester resin.

In the viewpoint of fluidity and storability of the toner, and preventing generation of an aurora phenomenon, the content of the styrene (meth)acrylic resin may be, for example from 10% by weight to 30% by weight with respect to the toner particle, preferably, from 12% by weight to 28% by weight, and more preferably, from 15% by weight to 25% by weight.

Release Agent

As the release agent, the hydrocarbon wax is employed. A ratio of the hydrocarbon wax with respect to the total release agent may be at least 85% by weight or more, preferably 95% by weight or more, and more preferably 100% by weight.

The hydrocarbon wax is a wax which has a hydrocarbon skeleton, and examples of the hydrocarbon wax include a Fischer-Tropsch wax, a polyethylene wax (a wax which has a polyethylene skeleton), a polypropylene wax (a wax which has a polypropylene skeleton), a paraffin wax (a wax which has a paraffin skeleton), or a microcrystalline wax. Among these, as the hydrocarbon wax, the Fischer-Tropsch wax may be employed in the viewpoint of preventing generation of an aurora phenomenon.

In the viewpoint of preventing generation of an aurora phenomenon, a melting temperature of the release agent may be, for example from 85° C. to 110° C., and preferably from 90° C. to 105° C.

In addition, the melting temperature of the release agent is determined by a "melting peak temperature" described in a determining method of the melting temperature of a JIS K-1987 "transition temperature measurement method of plastic", from the DSC curve obtained by the differential scanning calorimetry (DSC).

The content of the release agent is preferably from 1% by weight to 20% by weight with respect to the entire toner particle, and more preferably from 5% by weight to 15% by weight.

Colorant

Examples of the colorant include: various types of pigments, such as carbon black, chrome yellow, Hansa yellow, benzidine yellow, threne yellow, quinoline yellow, pigment yellow, permanent orange GTR, pyrazolone orange, vulcan orange, Watchung red, permanent red, brilliant carmine 3B, brilliant carrrrine 6B, Dupont oil red, pyrazolone red, lithol red, rhodamine B lake, lake red C, pigment red, rose Bengal, aniline blue, ultramarine blue, chalco oil blue, methylene blue chloride, phthalocyanine blue, pigment blue, phthalocyanine green, or malachite green oxalate; or various types of dyes, such as acridine type, xanthene type, azo type, benzoquinone type, azine type, anthraquinone type, thioindigo type, dioxazine type, thiazine type, azomethine type, indigo type, phthalocyanine type, aniline black type, polymethine type, triphenylmethane type, diphenylmethane type, or thiazole type.

One type of colorant may be used singly, or two or more types of colorants may be used together.

As the colorant, a surface-treated colorant may be used as necessary, and the colorant and a dispersant may be used together. In addition, plural colorants may be used together.

The content of the colorant is preferably from 1% by weight to 30% by weight with respect to the entire toner particle, and more preferably from 3% to 15% by weight.

Other Additives

Examples of other additives include a known additive, such as, a magnetic material, a charge-controlling agent, or an inorganic powder. These additives are included in the toner particle as the internal additive.

Characteristics or the Like of Toner Particle

The toner particle may be a toner particle which has a single layer structure, or may be a toner particle which has the so-called core-shell structure configured of a core (core particle) and a coated layer (shell layer) that covers a core. However, the toner particle which has the core-shell structure is preferable.

Here, the toner particle which has the core-shell structure is preferably configured of the core which includes the binder resin and other additives such as the colorant as necessary, and the coated layer which includes the binder resin and the release agent.

The volume average particle diameter (D50v) of the toner particle is preferably from 2 μm to 10 μm, and more preferably from 4 μm to 8 μm.

In addition, various average particle diameters and various particle size distribution indexes of the toner particle are measured by using a Coulter Multisizer-II (manufactured by Beckman coulter), and by using an ISOTON-II (manufactured by Beckman coulter) as an electrolyte.

For the measurement, 0.5 mg to 50 mg of the measurement sample is added to 2 ml of aqueous solution having 5% of surfactant as the dispersant (sodium alkylbenzene sulfonate is preferable). This is added to 100 ml to 150 ml of the electrolyte.

A dispersion process is performed for one minute by an ultrasonic homogenizer with respect to the electrolyte which suspends the sample. By the Coulter Multisizer-II, the particle size distribution of the particle having 2 μm to 60 μm of particle diameter is measured by using an aperture which is 100 μm in an aperture diameter. In addition, the number of sampling particles is 50000.

By drawing cumulative distribution of each of the volume and the number from a small diameter side with respect to a particle size range (channel) divided based on the measured particle size distribution, a particle diameter which has 16% of cumulation is defined as a volume average particle diameter D16v and a number average particle diameter D16p, a particle diameter which has 50% of cumulation is defined as a volume average particle diameter D50v and a cumulative number average particle diameter D50p, and a particle diameter which has 84% of cumulation is defined as a volume average particle diameter D84v and a number average particle diameter D84p.

By using these, a volume average particle size distribution index (GSDv) is calculated by $(D84v/D16v)^{1/2}$, and a number average particle size distribution index (GSDp) is calculated by $(D84p/D16p)^{1/2}$.

A shape factor SF1 of the toner particle is preferably from 110 to 150, and more preferably from 120 to 140.

In addition, the shape factor SF1 is determined by the following formula.

$$SF1=(ML^2/A)\times(\pi/4)\times 100 \quad \text{Formula:}$$

In the above-described formula, ML illustrates an absolute maximum length of the toner, and A illustrates a projected area of the toner.

Specifically, the shape factor SF1 is digitalized by mainly analyzing a microscopic image or a scanning electron microscope (SEM) image by using an image analyzing apparatus, and is calculated as follows. In other words, a calculation result is obtained by taking an optical microscopic image of the particle which is distributed on a surface of a slide glass into a Luzex image analyzing apparatus by a video camera, determining maximum lengths and projected areas of 100 particles, performing calculation by the above-described formula, and thereby determining the average value thereof.

External Additive

Examples of the external additive include an inorganic particle. Examples of the inorganic particle include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSo_4$, or $MgSO_4$.

A surface of the inorganic particle as the external additive may be hydrophobized. The hydrophobic treatment is performed, for example, by dipping the inorganic particle into a hydrophobizing agent. The hydrophobizing agent is not particularly limited, but examples of the hydrophobizing agent include a silane coupling agent, silicone oil, a titanate coupling agent, or an aluminate coupling agent. One type thereof may be used singly, or two or more types of these may be used together.

In general, an amount of the hydrophobizing agent is 1 part by weight to 10 parts by weight, for example, with respect to 100 parts by weight of an inorganic particle.

Examples of the external additive also include a resin particle (resin particles, such as polystyrene, PMMA, or a melamine resin), or a cleaning aid (for example, particles of metal salt of a higher fatty acid such as zinc stearate typically, and a fluorine-containing high molecular weight compound).

An amount of external additives is preferably from 0.01% by weight to 5% by weight, for example, with respect to the toner particle, and more preferably from 0.01% by weight to 2.0% by weight.

Preparing Method of Toner

The toner according to the exemplary embodiment may be the toner particle by preparing the toner particle, and may be a toner which is prepared by externally adding the external additive into the toner particle.

The toner particle may be prepared by any one of a dry method (for example, a kneading and pulverizing method) and a wet method (for example, an aggregating and coalescing method, a suspending and polymerizing method, and a dissolving and suspending method). The preparing method is not particularly limited to these methods, and a known preparing method is employed. Among these, a method of obtaining the toner particle by the aggregating and coalescing method is preferable.

Specifically, for example, when preparing the toner particle by the aggregating and coalescing method, the aggregating and coalescing method includes: a process (polyester resin particle dispersion preparation process) of preparing a polyester resin particle dispersion in which polyester resin particles are dispersed; a process (styrene (meth)acrylic resin particle dispersion preparation process) of preparing styrene (meth)acrylic resin particle dispersion in which styrene (meth)acrylic resin particles are dispersed; a process (release agent dispersion preparation process) of preparing a release agent dispersion in which release agent particles are dispersed; a process (first aggregated particle forming process) of aggregating the resin particle (even other particles as necessary) to thereby form a first aggregated particle, in a mixed dispersion (in which dispersions of other particle such as the colorant are also mixed as necessary) in which the two resin particle dispersions are mixed; a process (second aggregated particle forming process) of forming a second aggregated particle by mixing the first aggregated particle dispersion in which the first aggregated particles are dispersed, the polyester resin particle dispersion, and the release agent dispersion, and by performing the aggregation so that the polyester resin particles and the release agent particles are attached to the surface of the first aggregated particle; and a process (coalescence process) of forming a toner particle by heating the second aggregated particle dispersion in which the second aggregated particles are dispersed to thereby coalesce the second aggregated particle.

Hereinafter, each process of the aggregating and coalescing method will be described in detail. In the description below, a method in which the toner particle including the colorant is obtained is described, but the colorant is used as necessary. It goes without saying that additives other than the colorant may be used.

Resin Particle Dispersion Preparation Process

First, besides the resin particle dispersion in which the polyester resin particle that becomes the binder resin is dispersed, the styrene (meth)acrylic resin particle dispersion in which the styrene (meth)acrylic resin particles are dispersed, the colorant dispersion in which the colorant particles are dispersed, and the release agent dispersion in which the release agent particles are dispersed, are prepared.

The polyester resin particle dispersion is prepared, for example, by dispersing the polyester resin particle in a dispersion medium by the surfactant.

Examples of the dispersion medium which is used in the polyester resin particle dispersion include an aqueous medium.

Examples of the aqueous medium include: water, such as distilled water or deionized water; or an alcohol type. One type thereof may be used singly, or two or more types of these may be used together.

Examples of the surfactant include: an anionic surfactant, such as a sulfuric ester salt type, a sulfonate type, a phosphate ester type, or a soap type; a cationic surfactant such as an amine salt type or a quaternary ammonium salt type; and a nonionic surfactant, such as a polyethylene glycol type, an alkyl phenol ethylene oxide adduct type, or a polyol type. Among these, in particular, the anionic surfactant or the cationic surfactant are employed. The nonionic surfactant may be used together with the anionic surfactant and the cationic surfactant.

One type of surfactant may be used singly, or two or more types of surfactants may be used together.

Examples of a dispersing method of the polyester resin particles in the dispersing medium include a general dispersing method in which a rotation shearing type homogenizer, or a ball mill, a sand mill, and a dyno mill which have a media is used. In addition to this, a phase inversion emulsification method may be employed in dispersing the polyester resin particles in the dispersing medium. The phase inversion emulsification method is a method of performing phase inversion from W/O to O/W and dispersing a resin in an aqueous medium in a particle shape, by (1) dissolving the resin to be dispersed into a hydrophobic organic solvent which solubilizes the resin, (2) adding a base into the organic continuous phase (O phase) to perform neutralization, and (3) then inputting the water (W phase).

The volume average particle diameter of the polyester resin particles which are dispersed in the polyester resin particle dispersion is preferably from 0.01 μm to 1 μm, and more preferably from 0.08 μm to 0.8 μm, and still more preferably from 0.1 μm to 0.6 μm.

With respect to the volume average particle diameter of the polyester resin particles, the particle size distribution which is obtained by measurement of a laser diffraction type particle size distribution measurement apparatus (for example, LA-700 manufactured by Horiba, Ltd.) is used, the cumulative distribution regarding the volume from the small particle diameter side with respect to the divided particle size range (channel) is drawn, and 50% of the volume with respect to the entire particle is set as the volume average particle diameter D50v. In addition, the volume average particle diameter of the particles in other dispersions is measured in a similar manner.

The content of the polyester resin particle which is included in the polyester resin particle dispersion is preferably from 5% by weight to 50% by weight, and more preferably from 10% by weight to 40% by weight.

Similarly to the polyester resin particle dispersion, the styrene (meth)acrylic resin particle dispersion, the colorant dispersion, and the release agent dispersion are also prepared. In other words, the dispersing medium, the dispersing method, the volume average particle diameter of the particles, and the content of the particle with respect to the polyester resin particle dispersion, may be also applied to those with respect to the styrene (meth)acrylic resin particle dispersion, the colorant dispersion, and the release agent dispersion.

First Aggregated Particle Forming Process

Next, the polyester resin particle dispersion, the styrene (meth)acrylic resin particle dispersion, and the colorant dispersion, are mixed.

Then, in the mixed dispersion, the first aggregated particle is formed which heteroaggregates the polyester resin particles, the styrene (meth)acrylic resin particles, and the colorant particles are heteroaggregated to thereby prepare the first aggregated particle which has a diameter close to the diameter of the target toner particle, and includes the polyester resin particles, the styrene (meth)acrylic resin particles, and the colorant particles.

In addition, the release agent dispersion may be mixed as necessary, and the release agent particles may be included in the first aggregated particle.

Specifically, for example, the first aggregated particle is formed by adding an aggregating agent into the mixed dispersion, adjusting pH of the mixed dispersion to be acid (for example, from pH 2 to 5), and after adding a dispersion stabilizer as necessary, heating the temperature (specifically, for example, from −30° C. of the glass transition temperature of the polyester resin to −10° C. of the glass transition temperature) to be close to the glass transition temperature of the polyester resin to thereby aggregates the particles which are dispersed in the mixed dispersion.

The first aggregated particle forming process comprises, for example, adding the aggregating agent at a room temperature (for example, 25° C.) while stirring the mixed dispersion by the rotation shearing type homogenizer, adjusting pH of the mixed dispersion to be acid (for example, from pH 2 to 5), and after adding the dispersion stabilizer as necessary, heating may be performed.

Examples of the aggregating agent include a surfactant having a polarity reverse to that of a surfactant which is included in the mixed dispersion, for example, inorganic metal salt or a metal complex having a valence of two or more. When the metal complex is used as the aggregating agent, an amount of use of the aggregating agent is reduced, and charging characteristics are improved.

Together with the aggregating agent, an additive which forms a metal ion and complex or a similar bonding with the aggregating agent may be used. As the additive, a chelating agent may be appropriately used.

Examples of the inorganic metal salt include: metal salt, such as calcium chloride, calcium nitrate, barium chloride, magnesium chloride, zinc chloride, aluminum chloride, or aluminum sulfate; and an inorganic metal salt polymer, such as polyaluminum chloride, polyaluminium hydroxide, or calcium polysulfide.

As the chelating agent, an aqueous chelating agent may be used. Examples of the chelating agent include: an oxycarboxylic acid, such as a tartaric acid, a citric acid, or a gluconic acid; and an aminocarboxylic acid, such as an iminodiacetic acid (IDA), a nitrilotriacetic acid (NTA), or an ethylenediaminetetraacetic acid (EDTA).

An addition amount of the chelating agent is preferably from 0.01 parts by weight to 5.0 parts by weight with respect to 100 parts by weight of the resin particle, and more preferably 0.1 parts by weight or more and less than 3.0 parts by weight.

Second Aggregated Particle Forming Process

After obtaining the first aggregated particle dispersion in which the first aggregated particles are dispersed, the first aggregated particle dispersion, the polyester resin particle dispersion, and the release agent dispersion are further mixed. The polyester resin particle dispersion and the release agent dispersion may be mixed in advance, and the mixed agent may be mixed into the first aggregated particle dispersion.

The second aggregated particle is formed by performing aggregation so that the polyester resin particles and the release agent particles are attached to the surface of the first aggregated particle, in the mixed dispersion in which the first aggregated particles, the polyester resin particles, and the release agent particles are dispersed.

Specifically, for example, in the first aggregated particle forming process, when the first aggregated particle achieves the target particle diameter, the dispersion in which the polyester resin particles and the release agent particles are dispersed is mixed into the first aggregated particle dispersion. Next, the mixed dispersion is heated at a temperature which is equal to or lower than the glass transition temperature of the polyester resin, and the pH of the mixed dispersion is adjusted to be in a range from 6.5 to 8.5, for example, to thereby stop the progress of the aggregation is stopped.

Accordingly, the second aggregated particle in which the polyester resin particles and the release agent particles are attached to the surface of the first aggregated particle is obtained.

Coalescence Process

Next, the second aggregated particle dispersion in which the second particles are dispersed is heated at a temperature which is equal to or higher than the glass transition temperature (for example, a temperature which is equal to or higher than the glass transition temperature of the polyester resin by 10° C. to 50° C.) of the polyester resin, so that the second aggregated particles are coalesced to form a toner particle.

The toner particle is obtained through the above-described process.

After finishing the coalescence process, the toner particle in a dried state is obtained by performing a cleaning process, a solid-liquid separation process, and a dry process which are already known, to the toner particle which is formed in the solution.

In the viewpoint of conductivity, it is preferred that the cleaning process is sufficiently performed by displacement cleaning with deionized water. In addition, the solid-liquid separation process is not particularly limited, but in the viewpoint of productivity, the solid-liquid separation process may perform suction filtration or pressure filtration. In addition, the dry process is also not particularly limited, but in the viewpoint of productivity, the dry process may perform freeze drying, flash jet drying, fluidized drying, or vibration type fluidized drying.

The toner according to the exemplary embodiment is prepared, for example, by adding and mixing the external additive into the toner particle in a dried state. Mixing may be performed, for example, by a V blender, a Henschel mixer, or a Lödige mixer. Furthermore, as necessary, by using an oscillation sorting machine or a wind classifier, coarse particles may be removed.

Electrostatic Charge Image Developer

The electrostatic charge image developer according to the exemplary embodiment is a two-component developer which includes the toner according to the exemplary embodiment and the carrier.

The carrier is not particularly limited, and a known carrier is used. Examples of the carrier include: a coated carrier in which a surface of a core which is made of magnetic particle is coated with the coating resin; a magnetic particle dispersion type carrier in which the magnetic particle is dispersed and compounded in a matrix resin; or a resin impregnation type carrier in which a porous magnetic particle is impregnated with the resin.

In addition, the magnetic particle dispersing type carrier and the resin impregnation type carrier may be carriers in which the configuration particles of the carriers are cores, and the cores are coated with the coating resin.

Examples of the magnetic particle include a magnetic metal, such as iron, nickel, or cobalt, or a magnetic oxide, such as ferrite or magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinylketone, a vinyl chloride-vinyl acetate copolymer, a styrene-acrylic acid copolymer, a straight silicone resin having an organosiloxane bond or a modified product thereof, a fluorine resin, polyester, polycarbonate, a phenol resin, or an epoxy resin.

In addition, the coating resin and the matrix resin include other additives, such as a conductive particle.

Examples of the conductive particle include a metal, such as gold, silver, or copper, or a particle, such as carbon black, titanium oxide, zinc oxide, tin oxide, barium sulfate, aluminum borate, or potassium titanate.

Here, examples of the coating method of the surface of the core with the coating resin include a coating method by using a coated layer forming solution in which the coating resin and various additives, as necessary, are dissolved in an appropriate solvent. The solvent is not particularly limited, but may be selected by considering the coating resin to be used or suitability in coating.

Specific examples of the resin coating method include a dipping method of dipping the core in the coated layer forming solution, a spray method of spraying the coated layer forming solution onto the surface of the core, a fluid bed method of spraying the coated layer forming solution in a state where the core floats by fluid air, or a kneader-coater method of mixing the core of the carrier and the coated layer forming solution in the kneader-coater and removing the solvent.

From the viewpoint of preventing an aurora phenomenon, the carrier resistance of the carrier is suitably from $1.0\times10^{6.0}$ Ωcm to $1.0\times10^{15.0}$ Ωcm, in the electric field having $10^{4.8}$ V/m, preferably from $1.0\times10^{8.0}$ Ωcm to $1.0\times10^{15.0}$ Ωcm, more preferably from $1.0\times10^{9.0}$ Ωcm to $1.0\times10^{13.0}$ Ωcm, and still more preferably from $1.0\times10^{10.0}$ Ωcm to $1.0\times10^{12.0}$ Ωcm.

Here, the carrier resistance (Ωcm) is a value which is measured by the following method. In addition, the measurement environment temperature is 20° C. and humidity is 50% RH.

First, a carrier layer is formed by putting a carrier which is a measurement target on the surface of a circular jig which places a 20 $cm^2$ electrode plate, with a thickness in a range from 1 mm to 3 mm. The similar electrode plate having 20 $cm^2$ is put thereon so that the carrier layer is inserted therebetween. In order to eliminate a void between the carriers, the thickness (mm) of the carrier layer is measured after applying a 4 kg load onto the electrode plate which is put on the carrier layer. An electrometer and a high voltage source generating device are connected to both electrodes at upper and lower parts of the carrier layer. A high voltage is applied to both electrodes so that the electric fields of both electrodes have $10^{4.8}$ V/cm, and at this time, by reading out a flowing current value (A), the carrier resistance (Ωcm) is calculated. A formula for calculating the carrier resistance (Ωcm) is as illustrated in the following formula.

$$R=E\times20/(I-I_0)/L. \qquad \text{Formula:}$$

In the above-described formula, R represents the carrier resistance (Ωcm), E represents an applied voltage (V), I represents a current value (A), $I_0$ represents a current value (A) in the applied voltage 0V, and L represents a thickness (mm) of the carrier layer.

In addition, a coefficient of 20 represents an area ($cm^2$) of the electrode plate.

In the two-component developer, a mixing ratio (weight ratio) of the toner and the carrier is preferably from toner: carrier=1:100 to 30:100, and more preferably from 3:100 to 20:100.

Image Forming Apparatus/Image Forming Method

An image forming apparatus and an image forming method according to the exemplary embodiment will be described.

The image forming apparatus according to the exemplary embodiment includes: an image holding member; a charging unit which charges a surface of the image holding member; an electrostatic charge image forming unit which forms an electrostatic charge image on the surface of the charged image holding member; a developing unit which accommodates an electrostatic charge image developer and develops the electrostatic charge image formed on the surface of the image holding member as a toner image by the electrostatic charge image developer; a transferring unit which transfers the toner image formed on the surface of the image holding member to a surface of a recording medium; and a fixing unit which fixes the toner image transferred to the surface of the recording medium. As the electrostatic charge image developer, the electrostatic charge image developer according to the exemplary embodiment is employed.

In the image forming apparatus according to the exemplary embodiment, an image forming method (the image forming method according to the exemplary embodiment) including: a charging process of charging the surface of the image holding member; an electrostatic charge image forming process of forming the electrostatic charge image on the surface of the charged image holding member; a developing process of developing the electrostatic charge image formed on the surface of the image holding member as the toner image, by using the electrostatic charge developer according to the exemplary embodiment; a transferring process of transferring the toner image formed on the surface of the image holding member to the surface of the recording medium; and a fixing process of fixing the toner image transferred to the surface of the recording medium, is performed.

As the image forming apparatus according to the exemplary embodiment, a known image forming apparatus, such as a direct transfer type apparatus which transfers the toner image formed on the surface of the image holding member directly to the recording medium, an intermediate transfer type apparatus which primarily transfers the toner image formed on the surface of the image holding member to the surface of an intermediate transfer member, and secondarily transfers the toner image transferred to the surface of the intermediate transfer member to the surface of the recording medium, an apparatus which is provided with a cleaning unit that cleans the surface of the image holding member before charging, and an apparatus which is provided with a discharging unit which irradiates the surface of the image holding member before charging with discharging light after transferring the toner image to thereby discharge the surface of the image holding member, is employed.

In a case of the intermediate transfer type apparatus, in the transferring unit, for example, a configuration in which the intermediate transfer member the surface of which the toner image is transferred onto, the primary transferring unit which primarily transfers the toner image formed on the surface of the image holding member to the surface of the intermediate transfer member, and the secondary transferring unit which secondarily transfers the toner image transferred to the surface of the intermediate transfer member to the surface of the recording medium, is employed.

In addition, in the image forming apparatus according to the exemplary embodiment, for example, apart including the developing unit may have a cartridge structure (process cartridge) which is detachable from the image forming apparatus. As the process cartridge, for example, a process cartridge which is provided with the developing unit that accommodates the electrostatic charge image developer according to the exemplary embodiment is appropriately used.

Hereinafter, an example of the image forming apparatus according to the exemplary embodiment will be described, but the exemplary embodiment is not limited thereto. In addition, main parts illustrated in the drawing will be described, and the description of other parts will be omitted.

FIG. 1 is a schematic configuration view illustrating the image forming apparatus according to the exemplary embodiment.

The image forming apparatus illustrated in FIG. 1 is provided with a first to a fourth electron transfer type image forming units 10Y, 10M, 10C, and 10K (image forming units) which output images of each colors, such as yellow (Y), magenta (M), cyan (C), and black (K), based on color-separated image data. These image forming units (hereinafter, there is cases where the image forming unit is simply referred to as a "unit") 10Y, 10M, 10C, and 10K are aligned in parallel to be separated from each other by a preset distance in a parallel direction. In addition, these units 10Y, 10M, 10C, and 10K may be process cartridges which are detachable from the image forming apparatus.

At an upper part of the drawing of each unit 10Y, 10M, 10C, and 10K, an intermediate transfer belt 20 passes through each unit and extends as the intermediate transfer member. The intermediate transfer belt 20 is provided to be wound around a driving roll 22 and a supporting roll 24 which is in contact with an inner surface of the intermediate transfer belt 20, which are disposed to be separated from each other from left to right in the drawing, and travels in a direction toward the fourth unit 10K from the first unit 10Y. In addition, the supporting roll 24 is applied by a force in a direction of being apart from the driving roll 22 by a spring or the like, which is not illustrated, and a tension is given to the intermediate transfer belt 20 which is wound around both the driving roll 22 and the supporting roll 24. In addition, on a side surface of the image holding member of the intermediate transfer belt 20, an intermediate transfer member cleaning device 30 is provided facing the driving roll 22.

In addition, in each of developing devices (developing units) 4Y, 4M, 4C, and 4K in each unit 10Y, 10M, 10C, and 10K, a toner which includes a toner having each of four colors, such as yellow, magenta, cyan, and black, accommodated in toner cartridges 8Y, 8M, 8C, and 8K, is supplied.

Since the first to the fourth units 10Y, 10M, 10C, and 10K have similar configurations as each other, here, the first unit 10Y which is arranged on an upstream side of a traveling direction of an intermediate transfer belt and which forms a yellow image, will be described as a representative example. In addition, by providing reference numbers of magenta (M), cyan (C), and black (K) at a similar part to that of the first unit 10Y, instead of yellow (Y), the description of the second to the fourth units 10M, 10C, and 10K will be omitted.

The first unit 10Y has a photoreceptor 1Y which operates as the image holding member. In the periphery of the photoreceptor 1Y, a charging roll (an example of the charging unit) 2Y which charges a surface of the photoreceptor 1Y to a preset potential, an exposure device (an example of the electrostatic charge image forming unit) 3 which forms the electrostatic charge image by exposing the charged surface by using a laser beam 3Y based on a color-separated image signal, a developing device (an example of the developing unit) 4Y which supplies the charged toner to the electrostatic charge image and develops the electrostatic charge image, a primary transfer roll (an example of the primary transferring unit) 5Y which transfers the developed toner image onto the intermediate transfer belt 20, and a photoreceptor cleaning device (an example of the cleaning unit) 6Y which removes the toner that remains on the surface of the photoreceptor 1Y after the primary transfer, are disposed in order.

In addition, the primary transfer roll 5Y is disposed on an inner side of the intermediate transfer belt 20, and is provided at a position which faces the photoreceptor 1Y. Furthermore, each of bias supplies (not illustrated) which applies a primary transfer bias is connected to each of primary transfer rolls 5Y, 5M, 5C, and 5K. Each bias supply varies the transfer bias applied to each of the primary transfer rolls, by a control of a control portion, which is not illustrated.

Hereinafter, an operation of forming the yellow image in the first unit 10Y will be described.

First, before the operation, a surface of the photoreceptor 1Y is charged to a potential having −600 V to 800 V by using the charging roll 2Y.

The photoreceptor 1Y is formed by laminating a photosensitive layer on a substrate having conductivity (for example, a volume resistivity at 20° C.: $1\times10^{-6}$ Ωcm or less). The photosensitive layer generally has high resistance (resistance of a general resin), but when the photosensitive layer is irradiated with the laser beam 3Y, specific resistance of apart which is irradiated with the laser beam changes. Here, the laser beam 3Y is output to the surface of the charged photoreceptor 1Y via the exposure device 3, according to the image data for yellow which is sent from the control portion, which is not illustrated. The photosensitive layer of the surface of the photoreceptor 1Y is irradiated with the laser beam 3Y, and accordingly, the electrostatic charge image having the yellow image pattern is formed on the surface of the photoreceptor 1Y.

The electrostatic charge image is an image which is formed on the surface of the photoreceptor 1Y by charging, and is a so-called negative electrostatic charge image which is formed as follows: the specific resistance at a part of the photosensitive layer, which is irradiated with the laser beam 3Y, the specific resistance lowers so that a charge which is charged on the surface of the photoreceptor 1Y flows, and meanwhile, the charge at a part which is not irradiated with the laser beam 3Y remains.

The electrostatic charge image formed on the photoreceptor 1Y is rotated up to a preset development position according to the travel of the photoreceptor 1Y. At this development position, the electrostatic charge image on the photoreceptor 1Y becomes a visualized image (developed image) as the toner image, by a developing device 4Y.

In the developing device 4Y, for example, the electrostatic charge image developer which includes at least the yellow toner and the carrier is accommodated. The yellow toner is held on the developer roll (an example of a developer holding member), which performs frictional charging by stirring the inside of the developing device 4Y, and has a charge having the same polarity (negative polarity) as a band charge which is charged on the photoreceptor 1Y. As the surface of the photoreceptor 1Y passes through the developing device 4Y, the yellow toner is electrostatically attached to an electrostatic charge image portion which is discharged on the surface of the photoreceptor 1Y, and the electrostatic charge image is developed by the yellow toner. The photoreceptor 1Y in which the yellow toner image is formed travels at a continuous preset speed, and the toner image which is developed on the photoreceptor 1Y is transported to a preset primary transfer position.

When the yellow toner image on the photoreceptor 1Y is transported to the primary transfer position, a primary transfer bias is applied to the primary transfer roll 5Y, the electrostatic force toward the primary transfer roll 5Y from the photoreceptor 1Y influences the toner image, and the toner image on the photoreceptor 1Y is transferred onto the intermediate transfer belt 20. The transfer bias which is applied at this time has a (+) polarity reverse to (−) polarity of the toner, and for example, is controlled to be +10 μA by the control portion (not illustrated) in the first unit 10Y.

Meanwhile, the toner which remains on the photoreceptor 1Y is removed and collected by the photoreceptor cleaning device 6Y.

In addition, a first transfer bias which is applied to the first transfer rolls 5M, 5C, and 5K after the second unit 10M is also controlled similarly to the first unit.

In this manner, the intermediate transfer belt 20 in which the yellow toner image is transferred by the first unit 10Y performs transport passing through the second to the fourth units 10M, 10C, and 10K in order, and the toner images having each color are overlapped and multiple transferring is performed.

The intermediate transfer belt 20 which passes through the first to the fourth units, and in which the toner images having four colors are multiply transferred, reaches a secondary transfer portion which is configured of the supporting roll 24 which is in contact with the inner surface of the intermediate transfer belt 20, and a secondary transfer roll (an example of the secondary transferring unit) 26 which is disposed on an image holding surface side of the intermediate transfer belt 20. Meanwhile, a recording sheet (an example of the recording medium) P is supplied at a preset timing to a void to which the secondary transfer roll 26 and the intermediate transfer belt 20 come into contact, via a supply mechanism, and a secondary transfer bias is applied to the supporting roll 24. The transfer bias which is applied at this time has (−) polarity which is the same polarity as (−) polarity of the toner, the electrostatic force toward the recording sheet P from the intermediate transfer belt 20 influences the toner image, and the toner image on the intermediate transfer belt 20 is transferred onto the recording sheet P. In addition, the secondary transfer bias at this time is determined according to the resistance which is detected by a resistance detecting unit (not illustrated) that detects resistance of the secondary transfer portion, and is voltage-controlled.

After this, the recording sheet P is sent into a press contact portion (nipped portion) of a pair of fixing rolls in a fixing device (an example of the fixing unit) 28, the toner image is fixed onto the recording sheet P to thereby form the fixing image.

Examples of the recording sheet P which the toner image is to be transferred to include a plain paper which is used in an electron transfer type copying machine or a printer. In addition to the recording sheet P, examples of the recording medium also include an OHP sheet or the like.

In order to further improve the smoothness of the surface of the image after fixing is performed, it is preferable that the surface of the recording sheet P be smooth, and for example, a coated paper which is made by coating a surface of the plain paper with resin or the like, or a sheet of art paper for printing, is appropriately used.

The recording sheet P in which fixing of a color image is completed, is transported out toward an exit portion, and a series of color image forming operations is completed.

Process Cartridge/Toner Cartridge

The process cartridge according to the exemplary embodiment will be described.

The process cartridge according to the exemplary embodiment is a process cartridge which accommodates the electrostatic charge image developer according to the exemplary embodiment, is provided with the developing unit that develops the electrostatic charge image formed on the surface of the image holding member as the toner image, by the electrostatic charge image developer, and is detachable from the image forming apparatus.

In addition, the process cartridge according to the exemplary embodiment is not limited to the above-described configuration, and may be configured to include the developing device, and at least one selected from other unit, such as the image holding member, the charging unit, the electrostatic charge image forming unit, or the transferring unit, as necessary.

Hereinafter, an example of the process cartridge according to the exemplary embodiment will be described, but the exemplary embodiment is not limited thereto. In addition, main parts illustrated in the drawing will be described, and the description of other parts will be omitted.

Figure 2:
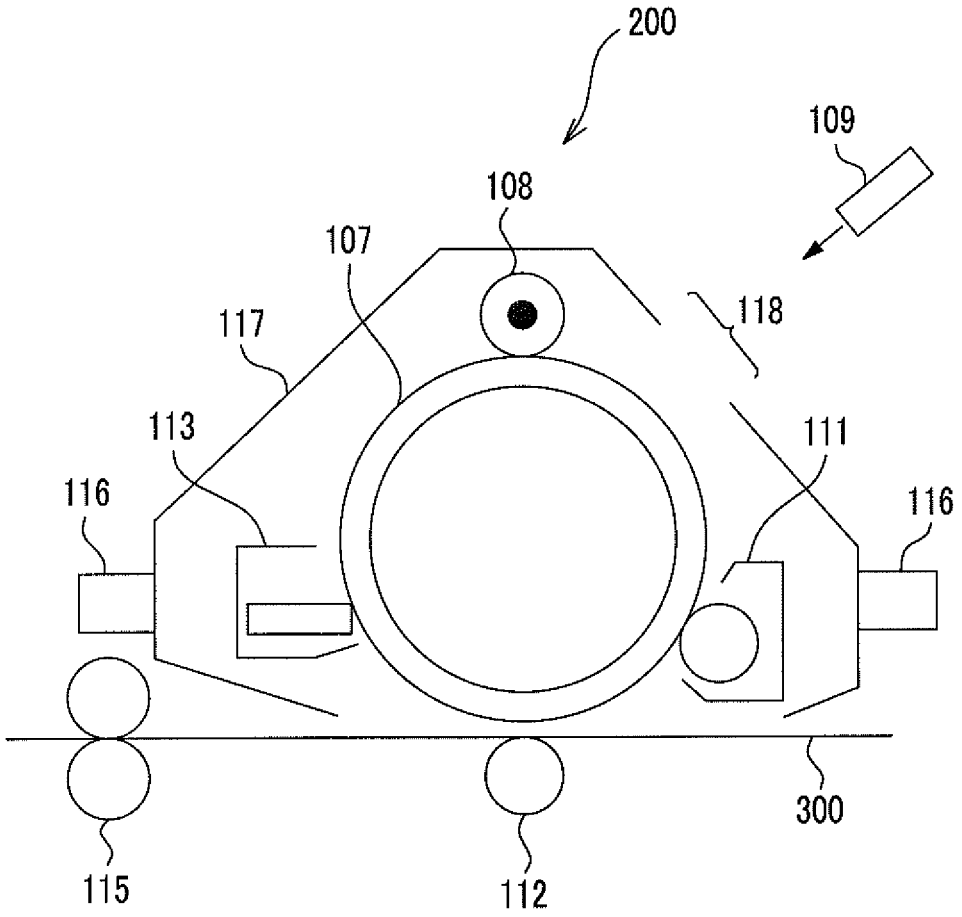
FIG. 2 is a schematic configuration view illustrating an example of a process cartridge according to the exemplary embodiment.

FIG. 2 is a schematic configuration view illustrating the process cartridge of the exemplary embodiment.

A process cartridge 200 illustrated in FIG. 2 is configured to integrally combine and hold a photoreceptor 107 (an example of the image holding member), a charging roll 108 (an example of the charging unit) which is provided in the periphery of the photoreceptor 107, a developing device 111 (an example of the developing unit), and a photoreceptor cleaning device 113 (an example of the cleaning unit), by a housing 117 which is provided with a mounting rail 116 and an opening portion 118 for exposure, and is made to be a cartridge.

In addition, in FIG. 2, reference number 109 represents the exposure device (an example of the electrostatic charge image forming unit), reference number 112 represents a transferring device (an example of the transferring unit), reference number 115 represents the fixing device (an example of the fixing unit), and reference number 300 represents the recording sheet (an example of the recording medium).

Next, the toner cartridge according to the exemplary embodiment will be described.

The toner cartridge according to the exemplary embodiment is a toner cartridge which accommodates the toner according to the exemplary embodiment and is detachable from the image forming apparatus. The toner cartridge accommodates the toner for replenishment in order to supply the toner to the developing unit provided in the image forming apparatus.

In addition, the image forming apparatus illustrated in FIG. 1 is an image forming apparatus which has a configuration from which the toner cartridges 8Y, 8M, 8C, and 8K are detachable, and the developing devices 4Y, 4M, 4C, and 4K are connected to the toner cartridges corresponding to each developing device (color) by a toner supply pipe, which is not illustrated. In addition, when the amount of toner accommodated in the toner cartridge runs low, the toner cartridge is exchanged.

EXAMPLE

Hereinafter, the exemplary embodiment will be described more specifically in detail with Examples and Comparative examples. However, the exemplary embodiment is not limited to any one of these Examples. In addition, "parts" and "%" which indicate an amount are on a weight basis if there is no particular notice.

Preparation of Polyester Resin Particle Dispersion 2.2 mol adduct of bisphenol A ethylene oxide: 40 parts by mole 2.2 mol adduct of bisphenol A propylene oxide: 60 parts by mole Dimethyl terephthalate: 60 parts by mole Dimethyl fumarate: 15 parts by mole Dodecenyl succinic acid anhydride: 20 parts by mole Trimellitic anhydride: 5 parts by mole The above-described monomers except the fumarate and the trimellitic anhydride, and 0.25 parts of dioctanoic acid tin with respect to total 100 parts of the above-described monomer are put into a reactor vessel which is provided with a stirrer, a thermometer, a capacitor, and a nitrogen gas introducing pipe. Under a flow of nitrogen gas, after performing reaction for 6 hours at 235° C., the temperature is reduced to 200° C., the fumarate and the trimellitic anhydride are input and allowed to react for 1 hour. The temperature increases to 220° C. over 5 hours, polymerization is performed until a predetermined molecular weight is achieved at 10 kPa of pressure, and a light-yellow transparent polyester resin (1) is obtained.

With respect to the polyester resin (1), the weight average molecular weight is 35,000, the number average molecular weight is 8,000, and the glass transition temperature is 59° C.

Next, the obtained polyester resin (1) is dispersed by using a dispersing machine which is improved from a Cavitron CD1010 (manufactured by Eurotec Limited.) to a high temperature and high pressure type. A solution having a composition ratio which is 80% of deionized water and 20% of concentration of the polyester resin is prepared, the pH is adjusted to 8.5 by ammonia, and the solution is subjected to dispersing treatment by the dispersing machine on the condition that a rotation speed of a rotor is 60 Hz, pressure is 5 $Kg/cm^2$, and a heating temperature is 140° C. by a heat exchanger, to thereby obtain a polyester resin dispersion (20% of solid content).

The volume average particle diameter of the resin particles in this dispersion is 130 nm. By adding deionized water into the dispersion, the solid content amount is prepared to be 20%, and this is taken as the polyester resin particle dispersion (1).

Preparation of Polyester Resin Particle Dispersion (2)

1,10-dodecane diacid: 50 parts by mole 1,9-nonane diol: 50 parts by mole

The above-described monomers are put into the reactor vessel which is provided with the stirrer, the thermometer, the capacitor, and the nitrogen gas introducing pipe, and after switching the inside gas of the reactor vessel to dry nitrogen gas, 0.25 parts of titanium tetrabutoxide with respect to 100 parts of the above-described monomer are input. Under a flow of nitrogen gas, after performing reaction by stirring for 3 hours at 170° C., the temperature further increases to 210° C. over 1 hour, the pressure in the reactor vessel is reduced to 3 kPa, the reaction is performed by stirring for 13 hours under the reduced pressure, and the polyester resin (2) is obtained.

With respect to the polyester resin (2), the weight average molecular weight is 25,000, the number average molecular weight is 10,500, an acid value is 10.1 mg KOH/g, and the melting temperature by the DSC is 73.6° C.

Next, the obtained polyester resin (2) is dispersed by using a dispersing machine which is improved from the Cavitron CD1010 (manufactured by Eurotec Limited.) to a high temperature and high pressure type. A solution having a composition ratio which is 80% of deionized water and 20% of concentration of the polyester resin is prepared, the pH is adjusted to 8.5 by ammonia, and the solution is subjected to dispersing treatment by the dispersing machine on the condition that a rotation speed of a rotor is 60 Hz, pressure is 5 $Kg/cm^2$, and a heating temperature is 140° C. by the heat exchanger to thereby obtain a polyester resin dispersion (20% of solid content).

The volume average particle diameter of the resin particles in this dispersion is 180 nm. By adding deionized water into the dispersion, the solid content amount is prepared to be 20%, and this is taken as the polyester resin particle dispersion (2).

Preparation of Styrene Acrylic Resin Particle Dispersion (Preparation of Styrene Acrylic Resin Particle Dispersion (1))

Styrene: 77 parts n-butylacrylate: 23 parts 1,10-decanediol diacrylate: 0.4 parts Dodecanthiol: 0.7 parts The solution which is prepared by dissolving 1.0 parts of an anionic surfactant (Dowfax manufactured by Dow Chemical Company) into 60 parts of the deionized water, is added into the mixed dissolved material of the above-described materials, is dispersed in a flask, and is emulsified to thereby obtain an emulsified liquid.

Then, 2.0 parts of the anionic surfactant (Dowfax manufactured by Dow Chemical Company) is dissolved in 90 parts of the deionized water, 20 parts of the emulsified liquid is added therein, and further, 10 parts of the deionized water which dissolves 1.0 parts of ammonium peroxodisulfate is input.

After this, remaining emulsified liquid is input over 3 hours, and nitrogen substitution is performed in the flask. After this, while stirring the solution in the flask, heating is performed until the temperature reaches 65° C. with an oil bath, emulsification and polymerization are continued for 5 hours as the heating is performed, and a styrene (meth) acrylic resin particle dispersion (1) is obtained. The solid content of the styrene (meth)acrylic resin particle dispersion (1) is adjusted to 32% by adding deionized water as necessary.

Preparation of Styrene Acrylic Resin Particle Dispersion (2)

Except that 2.0 parts of the anionic surfactant (Dowfax manufactured by Dow Chemical Company) of a solution added by 20 parts of the emulsified liquid are changed to 3.0 parts, and 20 parts of the added emulsified liquid are changed to 30 parts, the styrene acrylic resin particle dispersion (2) having 32% of solid content amount is obtained in a similar manner to the styrene acrylic resin particle dispersion (1).

Preparation of Styrene Acrylic Resin Particle Dispersion (3)

Except that 2.0 parts of the anionic surfactant (DOWFAX manufactured by Dow Chemical Company) of the solution added by 20 parts of the emulsified liquid are changed to 1.5 parts, the styrene acrylic resin particle dispersion (3) having 32% of solid content amount is obtained in a similar manner to the styrene acrylic resin particle dispersion (1).

Preparation of Styrene Acrylic Resin Particle Dispersion (4)

Except that 2.0 parts of the anionic surfactant (Dowfax manufactured by Dow Chemical Company) of the solution added by 20 parts of the emulsified liquid are changed to 4.0 parts, and 20 parts of the added emulsified liquid are changed to 40 parts, the styrene acrylic resin particle dispersion (4) having 32% of solid content amount is obtained in a similar manner to the styrene acrylic resin particle dispersion (1).

Preparation of Styrene Acrylic Resin Particle Dispersion (5)

Except that 2.0 parts of the anionic surfactant (Dowfax manufactured by Dow Chemical Company) of the solution added by 20 parts of the emulsified liquid are changed to 1.25 parts, the styrene acrylic resin particle dispersion (5) having 32% of solid content amount is obtained in a similar manner to the styrene acrylic resin particle dispersion (1).

Here, the volume average particle diameter of the particles in each styrene acrylic resin particle dispersion is illustrated in Table 1 as a list.

Preparation of Colorant Particle Dispersion

Preparation of Black Pigment Dispersion (1)

Carbon black (Regal330 manufactured by Cabot Corporation): 250 parts

Anionic surfactant (Neogen SC manufactured by Dai-ichi Kogyo Seiyaku Co., Ltd.): 33 parts (60% of active component, 8% with respect to the colorant)

Deionized water: 750 parts

Into a stainless steel vessel having a size in which a height of liquid surface when all of the above-described components are input is approximately ⅓ of a height of vessel, 280 parts of the deionized water and 33 parts of the anionic surfactant are input, and the surfactant is sufficiently dissolved. After this, all of the solid solution pigments are input, stirring is performed until there is no pigments which are not wet by using the stirrer, and defoaming is sufficiently performed. After defoaming, by adding remaining deionized water, dispersing is performed for 10 minutes by 5000 rotations, by using a homogenizer (Ultra-turrax T50 manufactured by IKA). After this, defoaming is performed by stirring for 24 hours by using the stirrer. After defoaming, dispersing is performed for 10 minutes by 6000 rotations by using the homogenizer again. After this, defoaming is performed by stirring for 24 hours by using the stirrer. Then, dispersing is performed at 240 MPa of pressure by using a high pressure impact type dispersing machine ultimizer (manufactured by Sugino Machine Limited, HJP30006). The dispersing is performed corresponding to 25 passes based on conversion from a total prepared amount and a processing capability of the apparatus. A precipitate is removed by keeping the obtained dispersion for 72 hours, the deionized water is added, concentration of the solid content is prepared to be 15%, and the colorant particle dispersion (1) is obtained. The volume average particle diameter D50 of the particles in this colorant particle dispersion (1) is 135 nm.

Preparation of Release Agent Dispersion

Preparation of Release Agent Dispersion (1)

Polyethylene wax (hydrocarbon wax: name of product is "Polywax 725 (manufactured by Baker Petrolite, Inc.)", melting temperature is 104° C.): 270 parts Anionic surfactant (manufactured by Dai-ichi Kogyo Seiyaku Co., Ltd., Neogen RK, active component amount: 60%): 13.5 parts (as an active component, 3.0% with respect to the release agent)

Deionized water: 21.6 parts

The above-described components are mixed, and the release agent is dissolved at 120° C. of inside temperature by using a pressure ejection type homogenizer (manufactured by Gaulin Inc., Gaulin homogenizer). After this, for 120 minutes at 5 MPa of dispersing pressure, and then, for 360 minutes at 40 MPa, a dispersing process is performed, and cooling is performed, and the release agent dispersion (1) is obtained. The volume average particle diameter D50 of the particles in the release agent dispersion (1) is 225 nm. After this, adjustment is performed so that the concentration of the solid content is 20.0% by adding the deionized water.

Preparation of Release Agent Dispersion (2)

Except that a wax is changed to a paraffin wax (hydrocarbon wax: name of product is "HNP0190 (manufactured by Nippon Seiro Co., Ltd.)", melting temperature is 85° C.) instead of the polyethylene wax, the release agent dispersion (2) is obtained in a similar manner to the release agent dispersion (1).

Preparation of Release Agent Dispersion (3)

Except that a wax is changed to a paraffin wax (hydrocarbon wax: name of product is "HNP9 (manufactured by Nippon Seiro Co., Ltd.)", melting temperature is 75° C.) instead of the polyethylene wax, the release agent dispersion (3) is obtained in a similar manner to the release agent dispersion (1).

Preparation of Release Agent Dispersion (4)

Except that a wax is changed to a polyethylene wax (hydrocarbon wax: name of product is "Polywax 1000 (manufactured by Baker Petrolite, Inc.)", melting temperature is 113° C.) instead of the polyethylene wax, the release agent dispersion (4) is obtained in a similar manner to the release agent dispersion (1).

Preparation of Release Agent Dispersion (5)

Except that a wax is changed to an end carboxylic acid synthetic ester wax (ester wax: name of product is "Kurovax 300-6S (manufactured by Nippon Kasei Chemical Co., Ltd.)", melting temperature is 95° C.) instead of the polyethylene wax, the release agent dispersion (5) is obtained in a similar manner to the release agent dispersion (1).

Preparation of Mixed Particle Dispersion

Preparation of Mixed Particle Dispersion (1)

After mixing 400 parts of the polyester resin particle dispersion (1), 60 parts of the release agent dispersion (1), and 2.9 parts of the anionic surfactant (manufactured by Dow Chemical Company, Dowfax 2A1), 1.0% of nitric acid is added at 25° C. and pH is adjusted to be 3.0, so that the mixed particle dispersion (1) is obtained.

Preparation of Mixed Particle Dispersion (2)

Except that 385 parts of the polyester resin particle dispersion (1) and 75 parts of the release agent dispersion (1) are mixed, the mixed particle dispersion (2) is obtained in a similar manner to the mixed particle dispersion (1).

Preparation of Mixed Particle Dispersion (3)

Except that 406 parts of the polyester resin particle dispersion (1) and 54 parts of the release agent dispersion (1) are mixed, the mixed particle dispersion (3) is obtained in a similar manner to the mixed particle dispersion (1).

Preparation of Mixed Particle Dispersion (4)

Except that each of the release agent dispersions (2) to (5) is used instead of the release agent dispersion (1), the mixed particle dispersions (4) to (7) are obtained in a similar manner to the mixed particle dispersion (1).

Preparation of Mixed Particle Dispersion (8)

Except that 409 parts of the polyester resin particle dispersion (1) and 24 parts of the release agent dispersion (1) are mixed, the mixed particle dispersion (8) is obtained in a similar manner to the mixed particle dispersion (1).

Example 1

Preparation of Toner Particle (1)

Polyester resin particle dispersion (1): 700 parts
Crystalline polyester resin particle dispersion (1): 50 parts
Styrene acrylic resin particle dispersion (1): 205 parts
Black pigment dispersion (1): 133 parts
Release agent dispersion (1): 15 parts
Deionized water: 600 parts
Anionic surfactant (manufactured by Dow Chemical Company, Dowfax 2A1): 2.9 parts The above-described materials are put into the reaction vessel having 3 liters of volume which is provided with a thermometer, a pH meter, and a stirrer, 1.0% of nitric acid is added at 25° C. of temperature, and pH is adjusted to be 3.0. After this, while performing dispersing at 3000 rpm by the homogenizer (Ultra-turrax T50 manufactured by IKA), 100 parts of aluminum sulfate aqueous solution having 2% of concentration is added.

In the middle of dripping this aggregating agent, viscosity of a raw material dispersion radically increases. For this reason, at a time when the viscosity increases, a dripping speed is reduced, and the aggregating agent is set not to be gathered at one location. After dripping of the aggregating agent is finished, the number of rotations is increased to 5,000 rpm and stirring is performed for 5 minutes.

After this, a stirrer and a mantle heater are installed in the reaction vessel, and the number of rotations of the stirrer is adjusted to sufficiently stir slurry. While doing this, a temperature raising rate is 0.2° C./minute until the temperature reaches 40° C., and a temperature raising rate is 0.05° C./minute after the temperature exceeds 40° C. and reaches 53° C. Every 10 minutes, the particle diameter is measured by the Multisizer-II (aperture diameter is 50 μm, manufactured by Beckman coulter). When the volume average particle diameter is 5.0 μm, the temperature is held, and 460 parts of the mixed particle dispersion (1) are charged over 5 minutes.

After holding this for 30 minutes at 50° C., in order to stop a growth of the aggregated particle which forms the coated layer, 8 parts of a 20% liquid of ethylenediaminetetraacetic acid (EDTA) with respect to the total amount of the dispersion being present in the reaction vessel is added. After this, 1 mol/liter of sodium hydroxide aqueous solution is added, and pH of raw material dispersion is controlled to be 9.0. After this, while adjusting pH to be 9.0 every 5° C., the temperature increases up to 90° C. at 1° C./minute, and the temperature is held at 90° C. When a particle shape and surface characteristics are observed by the optical microscope and the field emission scanning electron microscope (FE-SEM), since it is confirmed that the particles are coalesced in 6 hours, the vessel is cooled by a coolant over 5 minutes until the temperature is 30° C.

The slurry after cooling is allowed to pass through a nylon mesh having 15 μm of the aperture, coarse particles are removed, and the toner slurry which passes through the mesh is filtrated by an aspirator under reduced pressure. The solid content remained on a filter paper is broken down into small grains as much as possible by hand, the resulting solid content is charged into the deionized water which has 10 times the amount of the solid content at 30° C., and stirring and mixing are performed for 30 minutes. Then, after filtering the solid content by the aspirator under reduced pressure, breaking down the solid content remained on the filter paper into small grains as much as possible by hand, the resulting solid content is charged into the deionized water which has 10 times the amount of the solid content amount at 30° C., and performing stirring and mixing for 30 minutes, the solid content is filtrated by the aspirator under reduced pressure again, and electric conductivity of the filtrated liquid is measured. This operation is repeated until the electric conductivity of the filtrated liquid becomes 10 μS/cm or less, and the solid content is cleaned.

The cleaned solid content is broken down into small pieces by wet and dry type sizing machine (comil), vacuum drying is performed for 36 hours in an oven at 35° C., and the toner particle (1) is obtained. The volume average particle diameter of the toner particles (1) is 6.0

Preparation of Silica Particle

A stirrer, a dripping funnel, and a thermometer are set in a glass-made reaction vessel, 15 parts of ethanol and 28 parts of tetraethoxysilane are charged, and stirring is performed at 100 rpm of number of rotations while holding the temperature at 35° C. Next, while continuing stirring, 30 parts of an ammonia aqueous solution having a concentration of 20% are added dropwise over 5 minutes. After performing the reaction for 1 hour is performed, centrifugal separation is performed and a supernatant is removed. Furthermore, 100 parts of toluene is added thereto to prepare a suspension, and 60% by weight of hexamethyldisilazane is added with respect to the solid content amount in the suspension. After this, reaction is performed for 4 hours at 95° C. After this, the suspension is heated, the toluene is removed and dried. Then, the coarse particles are removed by a net for screening having an aperture of 106 μm, to thereby obtain a silica particle having 120 nm of number average particle diameter is obtained.

Preparation of Carrier (1)

500 Parts of spherical magnetite particle powder having a volume average particle diameter of 0.18 μm are charged into the Henschel mixer, and stirring is sufficiently performed. After this, 5.0 parts of titanate coupling agent is added thereto, the temperature is increased up to 95° C., and mixing and stirring are performed for 30 minutes to thereby obtain the spherical magnetite particle coated with the titanate coupling agent.

Next, 6.0 parts of phenol, 10 parts of 30% of formalin, 500 parts of the above-described magnetite particle, 7 parts of 25% of ammonia water, and 400 parts of water are charged into a four-necked flask having 1-liter of volume, and mixing and stirring are performed. Next, while stirring, the temperature is increased up to 90° C. for 60 minutes, and the reaction is performed for 180 minutes at the same temperature. After this, cooling is performed until the temperature is 30° C., and 500 ml of water is added. After this, the supernatant is removed, and the precipitate is cleaned with water. This is dried at 180° C. under reduced pressure, and the coarse particles are removed by the net for screening having 106 μm of aperture, so that core particle having 38 μm of average particle diameter is obtained.

Next, 200 parts of toluene and 35 parts of styrene-methylmethacrylate copolymer (component mole ratio is 10:90, weight average molecular weight is 160,000) are stirred by a stirrer for 90 minutes, so that a coat resin solution is obtained.

Next, 1000 parts of the core particle and 70 parts of the above-described coat resin solution are charged into a vacuum deairing type kneader-coater (clearance between a rotor and a wall surface is 35 mm), and stirring is performed for at 30 rpm for 30 minutes while holding the temperature at 65° C. After this, by further increasing the temperature to 88° C. and reducing pressure, distilling toluene, deairing, and drying are performed. Furthermore, bypassing the obtained material through the mesh having 75 μm of aperture, a carrier (1) is prepared. A shape factor SF2 of the carrier (1) is 104.

Preparation of Developer (1)

100 parts of the toner particle (1) and 1.5 parts of silica particle are blended at 20 m/s of circumferential speed for 15 minutes by using the Henschel mixer. After this, the coarse particles are removed by using a sieve having 45 μm of mesh, so that a toner (1) is obtained.

8 Parts of the obtained toner (1) and 100 parts of the carrier (1) are stirred for 20 minutes at 20 rpm by the V-blender, and sieving is performed by a sieve having 212 μm of mesh, so that a developer (1) is obtained.

Examples 2 to 14

According to Table 2, except that the types and the numbers of parts (amount) of the polyester resin particle dispersion (written as "PE dispersion" in the table), the styrene (meth)acrylic resin particle dispersion (written as "StAc dispersion" in the table), the release agent dispersion, and the mixed particle dispersion (written as "mixed dispersion" in the table), and the type of the carrier, are changed, developers (2) to (14) are obtained in a similar manner to the developer (1) of Example 1. However, with respect to the carrier other than the carrier (1), carriers which are obtained by preparing the carriers described below are used.

Comparative Examples 1 to 6

According to Table 3, except that the types and the numbers of parts (amount) of the polyester resin particle dispersion (written as "PE dispersion" in the table), the styrene (meth)acrylic resin particle dispersion (written as "StAc dispersion" in the table), the release agent dispersion, and the mixed particle dispersion (written as "mixed dispersion" in the table), and the type of the carrier, are changed, toners (C1) to (C6) are obtained in a similar manner to the developer (1) of Example 1. However, with respect to the carrier other than the carrier (1), carriers which are obtained by preparing the carriers described below are used.

Preparation of Carrier

Preparation of Carrier (2)

Except that the number of parts of the styrene-methylmethacrylate copolymer (component mole ratio (styrene: methacrylate) is 10:90, weight average molecular weight is 160,000) is changed to 30 parts, a carrier (2) is obtained in a similar manner to the carrier (1).

Preparation of Carrier (3)

Except that the number of parts of the styrene-methylmethacrylate copolymer (component mole ratio (styrene: methacrylate) is 10:90, weight average molecular weight is 160,000) is changed to 55 parts, a carrier (3) is obtained in a similar manner to the carrier (1).

Preparation of Carrier (4)

Except that the number of parts of the styrene-methylmethacrylate copolymer (component mole ratio (styrene: methacrylate) is 10:90, weight average molecular weight is 160,000) is changed to 28 parts, a carrier (4) is obtained in a similar manner to the carrier (1).

Preparation of Carrier (5)

Except that the number of parts of the styrene-methylmethacrylate copolymer (component mole ratio (styrene: methacrylate) is 10:90, weight average molecular weight is 160,000) is changed to 57 parts, a carrier (5) is obtained in a similar manner to the carrier (1).

Measurement

Regarding the toner particles of the developers obtained in each Example, according to the above-described methods, an "abundance of release agent" is investigated. In addition, regarding the styrene (meth)acrylic resin (written as "StAc resin" in the table), according to the above-described methods, a "particle diameter of domain" and a "number ratio of domain being in a range of ±0.1 μm of average diameter (written as "domain number ratio of ±0.1 μm of average particle)" are investigated. The result is illustrated in Table 2.

In addition, carrier resistance of the carriers of the developers obtained in each Example is also investigated. The result is illustrated in Tables 2 and 3. However, the carrier resistance is illustrated as a common logarithm value [log (Ωcm)].

Evaluation

Evaluation of Aurora Phenomenon

A developing device of "DocuCentreColor400CP" manufactured by Fuji Xerox Co., Ltd. is filled with the obtained developer.

At a high temperature and high humidity (on a condition that the temperature is 30° C. and the humidity is 90 RH %), by using the image forming apparatus, solid images having a low image density of 5% are continuously output onto 3000 A4 paper sheets. After this, entire halftone images on the A4 having a high image density of 80% are output onto 1000 A4 paper sheets, and the images which are output onto the first 10 paper sheets are visually observed.

An evaluation standard is as follows.

A: An aurora phenomenon is not observed in any images.

B: An aurora phenomenon is observed in some of the images, but not visually and remarkably recognized.

C: An aurora phenomenon which is visually and clearly recognized is observed in some of the images.

TABLE 1

| StAc dispersion | Volume average particle diameter (μm) |
|---|---|
| (1) | 0.1 |
| (2) | 0.06 |
| (3) | 0.2 |

TABLE 1-continued

| StAc dispersion | Volume average particle diameter (μm) |
|---|---|
| (4) | 0.05 |
| (5) | 0.25 |

TABLE 2

| | Toner (toner particle) | | | | | | |
|---|---|---|---|---|---|---|---|
| | | StAc | Release agent | Mixed | Release agent | | |
| | PE dispersion Type/Number of parts | dispersion Type/Number of parts | dispersion Type/Number of parts | dispersion Type/Number of parts | Type | Release agent abundance [%] | Content [% by weight] |
| Example 1 | (1)/700<br>(2)/50 | (1)/205 | (1)/15 | (1)/460 | Hydrocarbon | 80 | 4.5 |
| Example 2 | (1)/700<br>(2)/50 | (2)/205 | (1)/15 | (1)/460 | Hydrocarbon | 80 | 4.5 |
| Example 3 | (1)/700<br>(2)/50 | (3)/205 | (1)/15 | (1)/460 | Hydrocarbon | 80 | 4.5 |
| Example 4 | (1)/700<br>(2)/50 | (1)/103<br>(2)/102 | (1)/15 | (1)/460 | Hydrocarbon | 80 | 4.5 |
| Example 5 | (1)/700<br>(2)/50 | (1)/103<br>(2)/102 | (1)/15 | (1)/460 | Hydrocarbon | 80 | 4.5 |
| Example 6 | (1)/700<br>(2)/50 | (1)/205 | 0 | (2)/460 | Hydrocarbon | 100 | 4.5 |
| Example 7 | (1)/700<br>(2)/50 | (1)/205 | (1)/21 | (3)/460 | Hydrocarbon | 71 | 4.5 |
| Example 8 | (1)/700<br>(2)/50 | (1)/205 | (1)/15 | (1)/460 | Hydrocarbon | 80 | 4.5 |
| Example 9 | (1)/700<br>(2)/50 | (1)/205 | (1)/15 | (1)/460 | Hydrocarbon | 80 | 4.5 |
| Example 10 | (1)/700<br>(2)/50 | (1)/205 | (1)/15 | (1)/460 | Hydrocarbon | 80 | 4.5 |
| Example 11 | (1)/700<br>(2)/50 | (1)/205 | (1)/15 | (1)/460 | Hydrocarbon | 80 | 4.5 |
| Example 12 | (1)/700<br>(2)/50 | (1)/205 | (2)/15 | (4)/460 | Hydrocarbon | 80 | 4.5 |
| Example 13 | (1)/700<br>(2)/50 | (1)/205 | (3)/15 | (5)/460 | Hydrocarbon | 80 | 4.5 |
| Example 14 | (1)/700<br>(2)/50 | (1)/205 | (4)/15 | (6)/460 | Hydrocarbon | 80 | 4.5 |

| | Toner (toner particle) StAc resin | | | Carrier | | |
|---|---|---|---|---|---|---|
| | Domain average diameter [μm] | Number ratio of domain having average diameter ± 0.1 μm [%] | Content [% by weight] | Type | Carrier resistance [log(Ωcm)] | Evaluation Aurora phenomenon |
| Example 1 | 0.5 | 80 | 20 | (1) | 10 | A |
| Example 2 | 0.8 | 80 | 20 | (1) | 10 | B |
| Example 3 | 0.3 | 80 | 20 | (1) | 10 | B |
| Example 4 | 0.4 | 66 | 20 | (1) | 10 | B |
| Example 5 | 0.6 | 66 | 20 | (1) | 10 | B |
| Example 6 | 0.5 | 80 | 20 | (1) | 10 | B |
| Example 7 | 0.5 | 80 | 20 | (1) | 10 | B |
| Example 8 | 0.5 | 80 | 20 | (2) | 8 | A |
| Example 9 | 0.5 | 80 | 20 | (3) | 15 | A |
| Example 10 | 0.5 | 80 | 20 | (4) | 7 | B |
| Example 11 | 0.5 | 80 | 20 | (5) | 16 | B |
| Example 12 | 0.5 | 80 | 20 | (1) | 10 | A |
| Example 13 | 0.5 | 80 | 20 | (1) | 10 | A |
| Example 14 | 0.5 | 80 | 20 | (1) | 10 | A |

TABLE 3

| | Toner (toner particle) | | | | | | |
|---|---|---|---|---|---|---|---|
| | PE | StAc | Release agent | Mixed | Release agent | | |
| | dispersion Type/Number of parts | dispersion Type/Number of parts | dispersion Type/Number of parts | dispersion Type/Number of parts | Type | Release agent abundance [%] | Content [% by weight] |
| Comparative example 1 | (1)/700 (2)/50 | (4)/205 | (1)/15 | (1)/460 | Hydrocarbon | 80 | 4.5 |
| Comparative example 2 | (1)/700 (2)/50 | (5)/205 | (1)/15 | (1)/460 | Hydrocarbon | 80 | 4.5 |
| Comparative example 3 | (1)/700 (2)/50 | (1)/90 (2)/115 | (1)/15 | (1)/460 | Hydrocarbon | 80 | 4.5 |
| Comparative example 4 | (1)/700 (2)/50 | (1)/90 (3)/115 | (1)/15 | (1)/460 | Hydrocarbon | 80 | 4.5 |
| Comparative example 5 | (1)/700 (2)/50 | (1)205 | (1)/24 | (8)/460 | Hydrocarbon | 69 | 4.5 |
| Comparative example 6 | (1)/700 (2)/50 | (1)/205 | (5)/15 | (7)/460 | Ester | 80 | 4.5 |

| | Toner (toner particle) StAc resin | | | Carrier | | |
|---|---|---|---|---|---|---|
| | Domain average diameter [μm] | Number ratio of domain having average diameter ± 0.1 μm [%] | Content [% by weight] | Type | Carrier resistance [log(Ωcm)] | Evaluation Aurora phenomenon |
| Comparative example 1 | 0.9 | 80 | 20 | (1) | 10 | C |
| Comparative example 2 | 0.2 | 80 | 20 | (1) | 10 | C |
| Comparative example 3 | 0.38 | 63 | 20 | (1) | 10 | C |
| Comparative example 4 | 0.65 | 63 | 20 | (1) | 10 | C |
| Comparative example 5 | 0.5 | 80 | 20 | (1) | 10 | C |
| Comparative example 6 | 0.5 | 80 | 20 | (1) | 10 | B |

From the above-described result, it is found that the exemplary embodiment prevents generation of an aurora phenomenon compared to comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner, comprising:

toner particles containing:

a binder resin including a polyester resin;

a release agent including a hydrocarbon wax comprising a Fischer-Tropsch wax; and a styrene (meth)acrylic resin, wherein the toner particles have a core-shell structure comprised of a core particle and a shell layer that covers the core, wherein the shell layer comprises the binder resin and the release agent, and wherein 70% or more of the release agent is present within 800 nm from a surface of the toner particles, the styrene (meth)acrylic resin in the toner particles forms a domain having an average diameter from 0.3 μm to 0.8 μm, and a number ratio of the domain being in a range of ±0.1 μm of the average diameter is 65% or more.

2. The electrostatic charge image developing toner according to claim 1, wherein a ratio of the polyester resin with respect to the binder resin is 85% by weight or more.

3. The electrostatic charge image developing toner according to claim 1, wherein a glass transition temperature (Tg) of the polyester resin is from 50° C. to 80° C.

4. The electrostatic charge image developing toner according to claim 1, wherein a weight average molecular weight (Mw) of the polyester resin is from 5,000 to 1,000,000.

5. The electrostatic charge image developing toner according to claim 1, wherein a molecular weight distribution Mw/Mn of the polyester resin is from 1.5 to 100.

6. The electrostatic charge image developing toner according to claim 1, wherein a content of the binder resin is from 40% by weight to 95% by weight, with respect to the entire toner particles.

7. The electrostatic charge image developing toner according to claim 1, wherein a copolymerization ratio (on a weight basis, styrene monomer/(meth)acrylic monomer) between a styrene monomer and a (meth)acrylic monomer of the styrene (meth)acrylic resin is from 85/15 to 70/30.

8. The electrostatic charge image developing toner according to claim 1, wherein the styrene (meth)acrylic resin has a crosslinking structure.

9. The electrostatic charge image developing toner according to claim 8, wherein a copolymerization ratio (on a weight basis, crosslinkable monomer/entire monomer) of a crosslinkable monomer with respect to the entire monomer which constitutes the styrene (meth)acrylic resin is 2/1000 to 30/1000.

10. The electrostatic charge image developing toner according to claim 1, wherein a melting temperature of the release agent is from 85° C. to 110° C.

11. The electrostatic charge image developing toner according to claim 1, wherein a content of the release agent is from 1% by weight to 20% by weight, with respect to the entire toner particles.

12. The electrostatic charge image developing toner according to claim 1, wherein a shape factor SF1 of the toner particles is from 110 to 150.

13. The electrostatic charge image developing toner according to claim 1, wherein the toner particles contain 0.01% by weight to 5% by weight of an inorganic particle with respect to the toner particles.

14. The electrostatic charge image developing toner according to claim 13, wherein a surface of the inorganic particle is hydrophobized.

15. An electrostatic charge image developer, comprising:

the electrostatic charge image developing toner according to claim 1; and a carrier.

16. The electrostatic charge image developer, according to claim 15, wherein a carrier resistance of the carrier is from $1.0\times10^{8.0}$ Ωcm to $1.0\times10^{15.0}$ Ωcm, in an electric field of $10^{4.8}$ V/m.

17. The electrostatic charge image developer, according to claim 15, wherein the carrier is a carrier in which a magnetic material is dispersed in a resin.

18. The electrostatic charge image developer, according to claim 17, wherein the magnetic material is a magnetite which is coupling-processed.

19. A toner cartridge, which accommodates the electrostatic charge image developing toner according to claim 1, and is detachable from an image forming apparatus.

* * * * *